US011732552B1

(12) United States Patent
AlNasser et al.

(10) Patent No.: US 11,732,552 B1
(45) Date of Patent: Aug. 22, 2023

(54) SCALE SAMPLER PLUNGER

(71) Applicant: SAUDI ARABIAN OIL COMPANY, Dhahran (SA)

(72) Inventors: Fatimah H. AlNasser, Dhahran (SA); Jose Daniel Valbuena Fuenmayor, Dhahran (SA); Gustavo Ariel Alvarez, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/056,898

(22) Filed: Nov. 18, 2022

(51) Int. Cl.

| | |
|---|---|
| ***E21B 37/04*** | (2006.01) |
| ***E21B 43/12*** | (2006.01) |
| ***E21B 43/34*** | (2006.01) |
| ***E21B 27/00*** | (2006.01) |

(52) U.S. Cl.
CPC ..... *E21B 37/045* (2013.01); *E21B 27/00* (2013.01); *E21B 43/121* (2013.01); *E21B 43/35* (2020.05)

(58) Field of Classification Search
CPC ..... E21B 37/04; E21B 37/045
See application file for complete search history.

(56) References Cited

U.S. PATENT DOCUMENTS 541,699 A * 6/1895 Stevenson ..... E21B 27/00 166/99
1,300,346 A * 4/1919 Church ..... E21B 27/00 175/321
2,397,419 A * 3/1946 Humason ..... E21B 41/00 417/87
2,659,442 A * 11/1953 Sutliff ..... E21B 27/005 294/86.11
3,356,137 A 12/1967 Raugust
3,394,763 A * 7/1968 Page, Jr. ..... E21B 37/04 166/170

(Continued)

FOREIGN PATENT DOCUMENTS

WO 2021185947 A1 9/2021

OTHER PUBLICATIONS

Zheng, Tong, et al., "A plunger lift and monitoring system for gas wells based on deployment-retrievement integration", Natural Gas Industry B, ScienceDirect, Elsevier B.V., vol. 2, 2015, pp. 449-454 (6 pages).

*Primary Examiner* — Kipp C Wallace
(74) *Attorney, Agent, or Firm* — Osha Bergman Watanabe & Burton LLP

(57) ABSTRACT

A scale sampler plunger having an upper end and a downhole end for a plunger lift system in a tubing string comprising: a solid cylindrical member at the upper end of the scale sampler plunger configured to remove a plurality of contaminants in the tubing string; a lower sub at the downhole end of the scale sampler plunger threaded to the solid cylindrical member, wherein the lower sub comprises a first section threaded to a second section extending axially from the first section; wherein a fluid stream carrying solids flows from the tubing string into an entry opening located in the second section; a deflector disposed in a chamber in the lower sub, wherein the deflector causes the fluid stream carrying solids to deposit the solids in the chamber in the lower sub; and an anchor disposed in the entry opening, wherein the anchor is fastened to the deflector.

20 Claims, 5 Drawing Sheets

(56) References Cited

U.S. PATENT DOCUMENTS

| | | | | |
|---|---|---|---|---|
| 3,395,759 | A * | 8/1968 | Talley, Jr. | E21B 37/045 166/170 |
| 4,142,594 | A | 3/1979 | Thompson et al. | |
| 6,158,276 | A | 12/2000 | Patey et al. | |
| 10,753,186 | B1 * | 8/2020 | Zimmerman, Jr. | E21B 43/13 |
| 2005/0178543 | A1 * | 8/2005 | Giacomino | E21B 47/01 166/250.01 |
| 2006/0124294 | A1 * | 6/2006 | Victor | E21B 17/07 166/105 |

* cited by examiner

SCALE SAMPLER PLUNGER

BACKGROUND

In hydrocarbon well development, it is common practice to use plunger lift systems as a primary form of artificial lift. A challenge with plunger lift operations is well loading and scale deposition. As a solution for well loading, plunger lift utilizes a freely traveling piston that lifts the fluid accumulated in the tubing to the surface.

During selection of chemical treatment, collecting downhole scale samples is critical. A common method involves slickline or coil tubing requiring many preparatory steps such as well shut-in, equipment rig up, pressure testing, and etc. Similar to other well intervention operations, downhole sample collection introduces additional cost to the operation, downtime, and risk. Accordingly, there exists a need for an optimization opportunity by merging the functions of a plunger and a downhole sampler into one tool.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a scale sampler plunger having an upper end and a downhole end for a plunger lift system in a tubing string comprising: a solid cylindrical member at the upper end of the scale sampler plunger configured to remove a plurality of contaminants in the tubing string; a lower sub at the downhole end of the scale sampler plunger threaded to the solid cylindrical member, wherein the lower sub comprises a first section threaded to a second section extending axially from the first section; wherein a fluid stream carrying solids flows from the tubing string into an entry opening located in the second section; a deflector disposed in a chamber in the lower sub, wherein the deflector causes the fluid stream carrying solids to deposit the solids in the chamber in the lower sub; and an anchor disposed in the entry opening, wherein the anchor is fastened to the deflector and is configured to connect the entry opening to the deflector.

In one aspect, one or more embodiments relate to a method of removing solids from a tubing string in a well, the method comprising: disposing a scale sampler plunger in the tubing string having a solid cylindrical member threaded to a lower sub, wherein the lower sub comprises a first section threaded to a second section, wherein a deflector is arranged within a chamber in the lower sub and is connected by an anchor to an entry opening of the second section; removing a plurality of contaminants from the well via the solid cylindrical member; flowing a fluid stream carrying solids from the well into the lower sub via the entry opening to the second section, wherein solids are deposited into the chamber in the lower sub by the deflector; departing the fluid stream from the first section, via an outlet, into the tubing string; retrieving the scale sampler plunger from the well; and collecting the solids, via the scale sampler plunger, for sampling.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
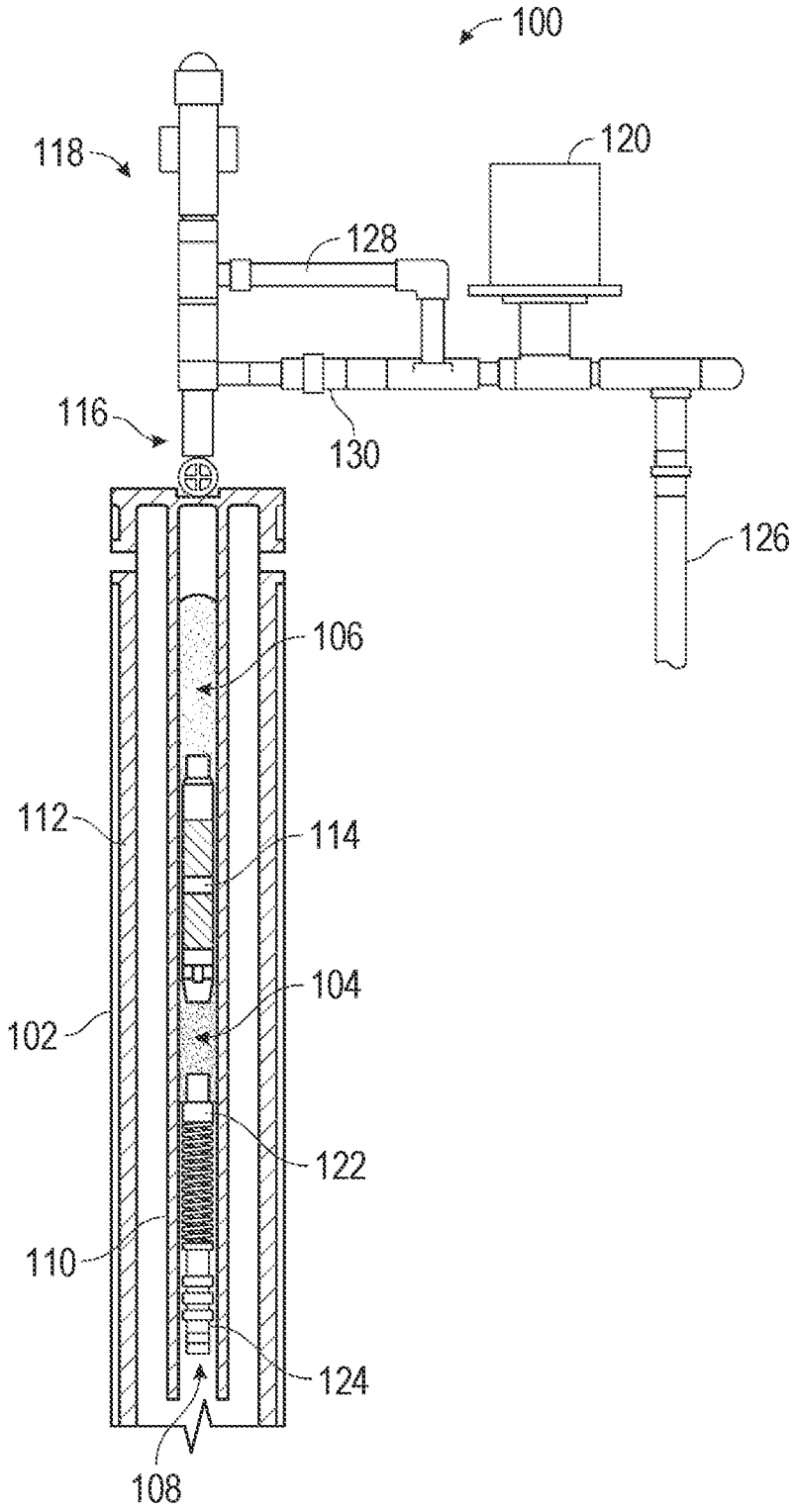
FIG. 1 shows a schematic of a production system utilizing a plunger lift system in a well with one or more embodiments of the present disclosure.

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Embodiments of the present disclosure may provide at least one of the following advantages.

FIG. 1 shows schematic of a production system utilizing a plunger lift system (100) in a well (102) with one or more embodiments of the present disclosure. The plunger lift system (100) is one example of an artificial lift system that is used to help remove water and condensate from the well (102). The plunger lift system (100) uses gas (104) pressure buildup in the well (102) to lift a column of accumulated liquid (106) out of the well (102). The well (102) may be formed by drilling a wellbore into the surface of the earth by conventional techniques, where at least some of the wellbore may be cased with cement and/or steel to increase formation stability. The wellbore may extend from the surface and penetrate a reservoir containing fluids (108). The fluids (108) may be gaseous. The well (102) may have a high gas liquid ratio (GLR). It is common in the industry for gas (104) production to halt due to an accumulation of fluids (108). Gas (104) flow may be maintained by removing accumulated fluids. Fluids (108) may be removed by the plunger lift system (100).

The plunger lift system (100) may include a plunger (114) and bottomhole bumper (122) in the tubing string (110) within the casing (112) of the well (102). The plunger lift system (100) uses the plunger (114) inside the tubing string (110). The tubing string (110) may be a production tubing. The plunger (114) may act as a piston between liquid (106) and gas (104) in the tubing string (110). The plunger (114) may be moved uphole and downhole by pressure from the gas (104). At the wellhead (116), the plunger lift system (100) may have a lubricator/catcher (118) and a controller (120). In operations, the plunger (114) may originally rest on the bottomhole bumper (122). The bottomhole bumper (122) may rest on a tubing stop (124). The tubing stop (124) may be a completion component fabricated as a short section of heavy wall tubular used as platform to land various tools. The tubing stop (124) may prevent the bottomhole bumper (122) from travelling down the tubing string (110). During gas production, liquids may accumulate in the wellbore. Gas production may decrease when traveling to a sales line (126) due to back-pressure increase from the liquid (106) accumulation.

The controller (120) may be an electronic control system installed on the surface. The controller (120) may include sensors used to operate a valve at the wellhead (116). The valve at the wellhead (116) may regulate the buildup of gas (104) in the casing (112). The controller (120) may recognize the increase of back-pressure and shut-in the valve at the wellhead (116). Pressure may then increase in the well (102) as gas (104) accumulates in the annulus between the casing (112) and the tubing string (110). The gas (104) may push the plunger (114) and the liquid (106) accumulated above it to the surface ( ). The plunger (114) may have a solid or semi-hollow body. The plunger (114) may be of a cylindrical shape. The plunger (114) may contain brushes, pads, or spirals on the outer layer of the body.

The plunger (114) may move uphole to the lubricator/catcher at the wellhead (116). The liquid (106) above the plunger (114) moves uphole along with the plunger (114) to be removed from the well (102). The gas (104) and accumulated liquids (106) above the plunger (114) flow as the plunger (114) moves uphole. The gas (104) and accumulated liquids (106) may flow through upper outlets (128) and lower outlets (130). The upper outlets (128) and lower outlets (130) may be located on a pipeline connected to the wellhead (116). The plunger (114) may be caught by the lubricator/catcher and the gas that lifted the plunger (114) flows through the lower outlet (130) and the sales line (126). The controller (120) may shut-in the well and release the plunger (114) as gas flow stabilizes. The plunger (114) may then move back downhole to the bottomhole bumper (122). The bottomhole bumper (122) may include a spring. The cycle may continue as necessary such as cyclic production.

Figure 2A:
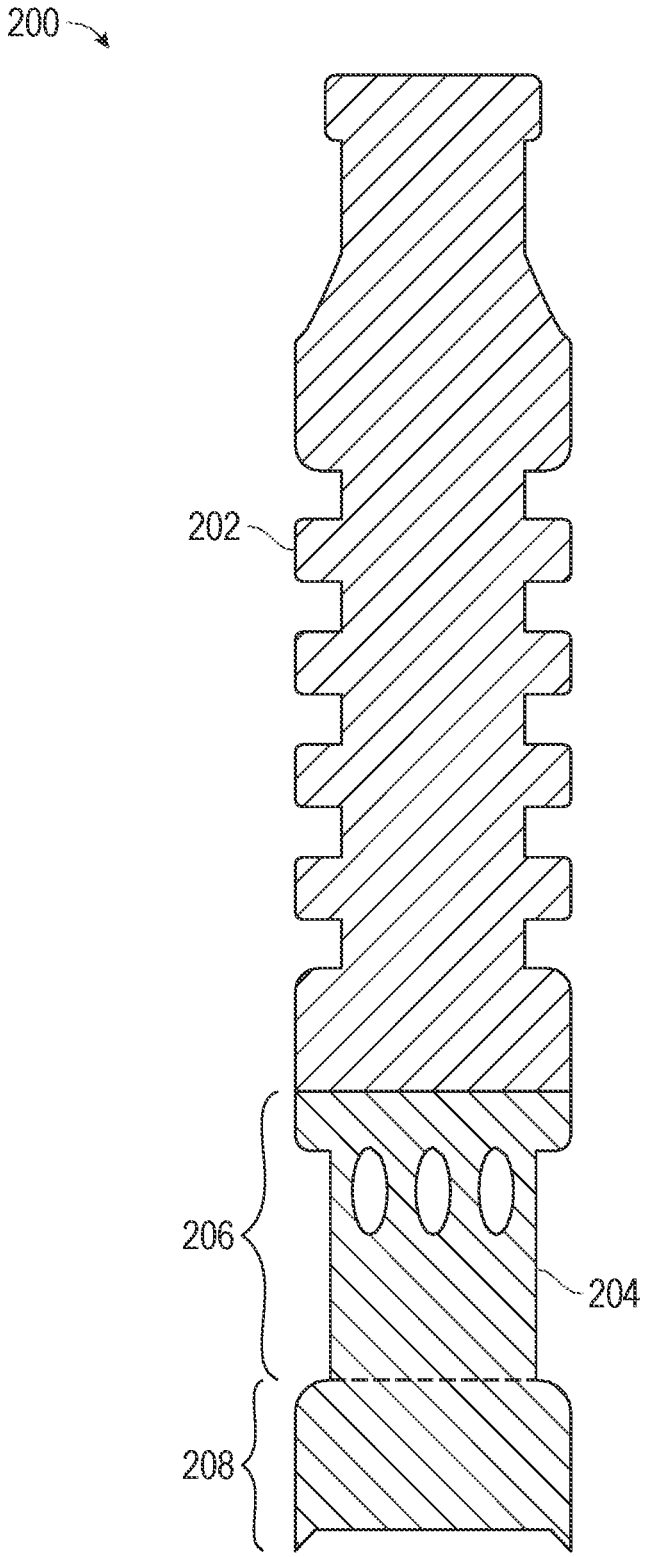
FIG. 2A-2D shows a device used in conjunction with the one or more embodiments in FIG. 1.

FIG. 2A-2D shows a device in accordance with one or more embodiments. In some embodiments, the plunger lift system (100) includes a scale sampler plunger (200) used in place of the plunger (114) in FIG. 1. It is common in the industry for mature gas wells to encounter well loading and scale deposition. The scale sampler plunger (200) can be a solution for well loading and scale deposition. The scale sampler plunger (200) may have the ability to move uphole and downhole based on pressure. The scale sampler plunger (200) may have the ability to collect samples for the selection of chemical treatment for scale deposition. The scale sampler plunger (200) has an upper end and a downhole end. The scale sampler plunger (200) has a solid cylindrical member (202) in the upper end and a lower sub (204) in the downhole end as shown in FIG. 2A. The solid cylindrical member (202) may be a tool designed to provide an interface between the liquid (106) and the lift gas (104). The solid cylindrical member (202) may be configured to remove contaminants in the tubing string (110) such as water, sand, oil, and solids. The solid cylindrical member (202) may be a regular solid ring or brush plunger. The solid cylindrical member (202) is threaded to the lower sub (204). The threading may be a connection or fastener such as machine screws, nuts, or bolts. In one or more embodiments, the fluid (108) in the well (102) may be a fluid stream carrying solids. The fluid stream carrying solids may contain a liquid component, a gas component, and solids. Solids such as salt, sand, and other particles may be found in the fluid (108).

FIG. 2A further shows an upper section (206) and a lower section (208) in the lower sub (204). While the embodiment shown is deployed in a vertical well, those skilled in the art will readily appreciate that either of the upper section (206) and the lower section (208) may be considered a "first section" and the other may be considered a "second section" in either orientation depending on the operating environment of the device. The lower section (208) extends axially from the upper section (206).

Figure 2B:
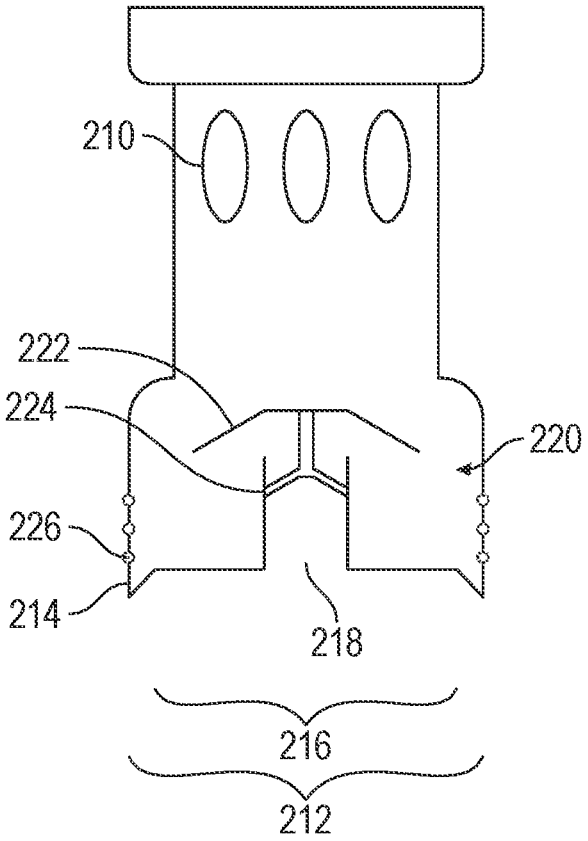

FIG. 2B shows a schematic of the lower sub (204) and its components. The upper section (206) has one or more outlets (210) designed for fluid (108) to flow into the tubing string (110). The outlets (210) may be modified for size to control fluid (108) circulation speed and retention time for solid deposition. The lower section (208) has an outer diameter (212) and hardened edge (214) as shown in FIG. 2B. The maximum outer diameter (212) may be manufactured to the tubing string (110) drift inner diameter. The outer layer of the lower sub (204) includes a hardened edge (214) for thorough tubing string (110) clean up. The hardened edge (214) may cover the full circumference of the lower sub (204). The hardened edge (214) may be used to scrape off scale from the tubing string (110) wall. An inner portion (216) between the hardened edges (214) may be flat as shown in FIG. 2. The inner portion (216) may be manufactured with an outer diameter greater than the bottomhole bumper (122) fish neck outer diameter in order to ensure proper contact between the bottomhole bumper (122) and scale sampler plunger (200).

The lower sub (204) includes an entry opening (218), a chamber (220), exit outlets (226), a deflector (222), and an anchor (224) in the lower section (208). The entry opening (218) is located in the inner portion (216) of the lower sub. The fluid stream carrying solids flow from the tubing string (110) into the entry opening (218). The entry opening (218) may be an entry point hydraulically connected to the lower sub (204). The maximum length of the entry opening (218) must be less than the bottomhole bumper (122) fish neck outer diameter. The fluid (108) stream carrying solids flows through the entry opening (218) towards a deflector (222). The deflector (222) is connected to the entry opening (218) by an anchor (224). The anchor (224) may fasten the deflector (222) to the entry opening (218). The deflector (222) may be a tool designed to redirect the fluid flow into the chamber (220). Upon impact with the deflector (222), the fluid (108) flow speed decreases and solids may drop into the chamber (220). The chamber (220) may be a receptacle to store and collect solids or scale that may be retrieved on surface. The chamber (220) may be emptied. Fluid (108) may filter through one or more exit outlets (226) located in the lower section (208). The size of the exit outlets (226) may be modified to control the amount of solids collected. Fluid may flow through one or more outlets (210) located in the upper section (206).

Figure 2C:
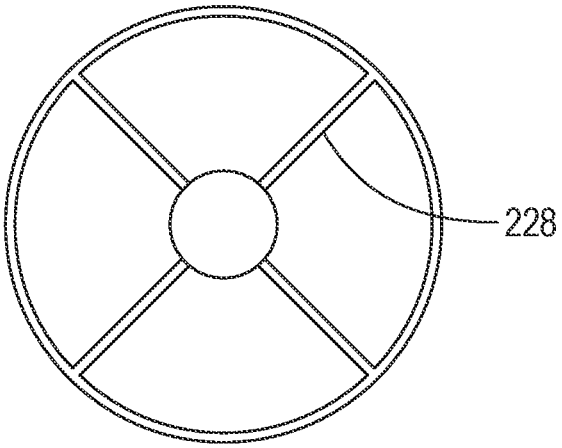
Figure 2D:
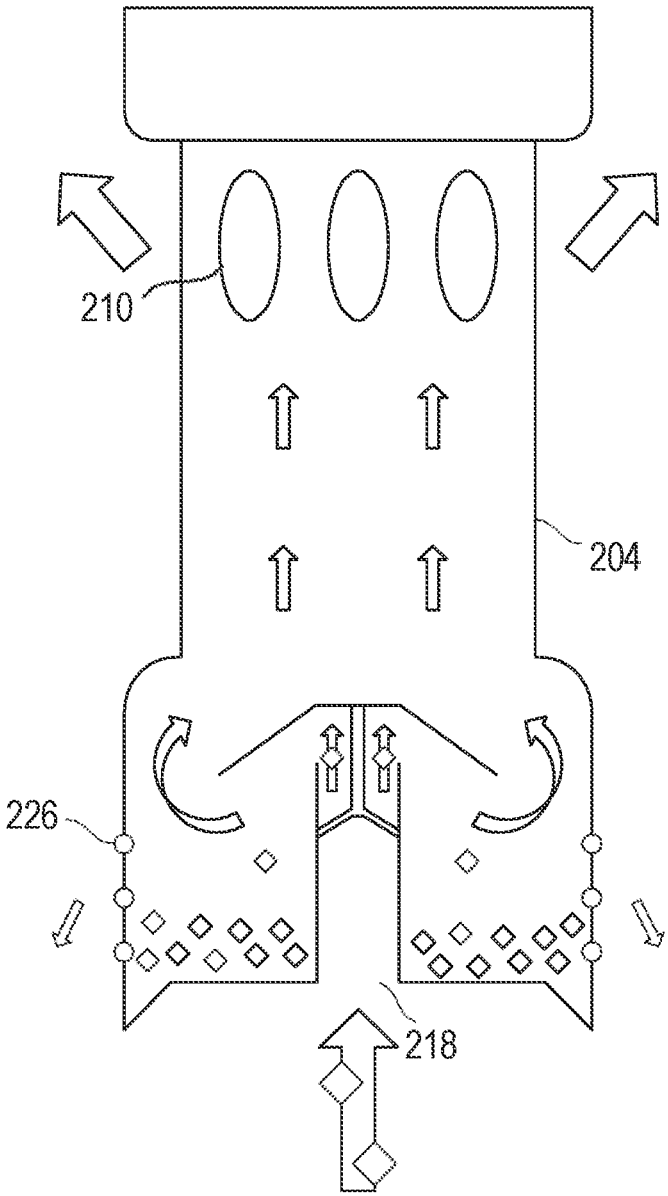

FIG. 2C shows a cross section of the entry opening (218) in the lower sub (204). The anchor (224) may have anchor legs (228) as shown in FIG. 2C. There may be at least two anchor legs (228) connecting the deflector (222) to the entry opening (218). The anchor legs (228) create an opening between the anchor legs (228) for the fluid (108) stream to flow. The anchor legs (228) do not restrict fluid (108) entry into the lower sub (204). FIG. 2D shows the process of the lower sub (204) in accordance with one or more embodiments. The fluid (108) stream carrying solids flows into the entry opening (218). The fluid (108) is redirected by the deflector (222) depositing solids into the chamber (220). The fluid (108) filters out of the lower sub (204) and into the tubing string (110) through the outlets (210) and exit outlets (226).

Figure 3:
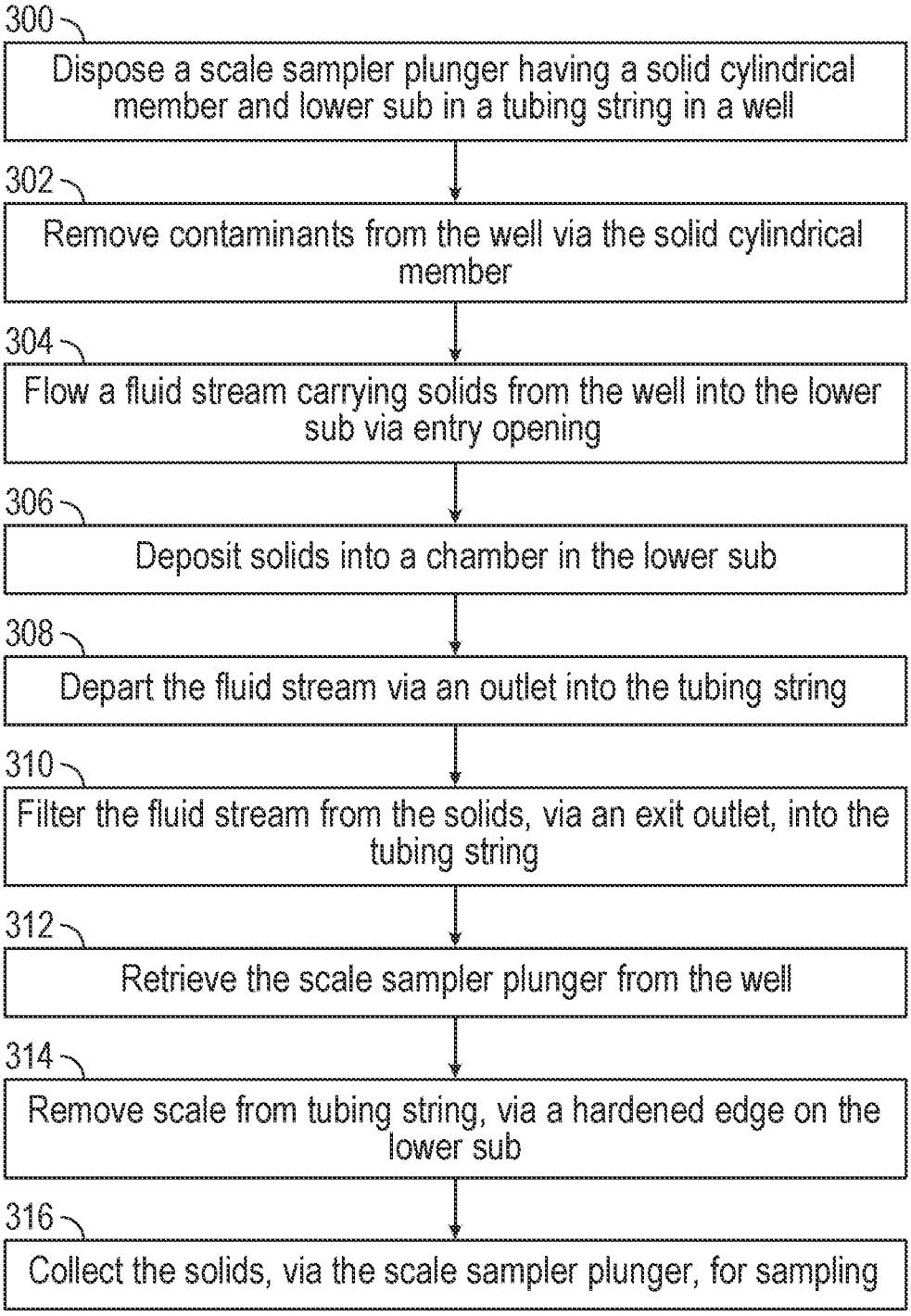
FIG. 3 shows a flowchart in accordance with one or more embodiments.

FIG. 3 shows a flowchart in accordance with one or more embodiments. Specifically, the flowchart illustrates a method for removing solids from a tubing string (110) in a well (102) using a scale sampler plunger (200). Further, one or more blocks in FIG. 3 may be performed by one or more components as described in FIGS. 1-2. While the various blocks in FIG. 3 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, the scale sampler plunger (200) having a solid cylindrical member (202) and a lower sub (204) is disposed in the tubing string (110) (Block 300). The tubing string (110) may be a production tubing. The solid cylindrical member (202) is threaded to a lower sub (204). The lower sub (204) further includes an upper section (206) threaded to a lower section (208). As mentioned previously, throughout the disclosed embodiments, one skilled in the art will readily appreciate that either the upper section (206) or the lower section (208) may be considered a "first section" or a "second section" in either orientation depending on the operating environment of the device. The lower sub (204) further includes a chamber (220) and an entry opening (218) in the lower section (208). A deflector (222) is arranged within the chamber (220) and is connected to the entry opening (218) by an anchor (224). The anchor (224) includes at least two anchor legs (228). The anchor legs (228) may create an opening between the anchor legs (228) for the fluid (108) stream to flow.

In Block 302, a plurality of contaminants is removed from the well (102) via the solid cylindrical member (202). The solid cylindrical member (202) may be a plunger. The plunger may be a solid ring plunger or a brush plunger. The plurality of contaminants may be scale. The entry opening (218) is in the lower section (208) so as to flow a fluid (108) stream carrying solids from the well (102) into the lower sub (204) via an entry opening in the lower sub (Block 304). In Block 306, solids are deposited into a chamber (220) in the lower sub (204). The deflector (222) may cause the fluid (108) stream carrying solids to deposit the solids in the chamber (220). The chamber (220) defines a receptacle in the lower sub (204). In Block 308, the fluid (108) stream departs the lower sub (204) via an outlet (210) into the tubing string (110). In Block 310, the fluid (108) stream is filtered from the solids, via an exit outlet (210), into the tubing string (110). The exit outlet (210) is located in the upper section (206). In Block 312, the scale sampler plunger (200) is retrieved from the well (102). As the scale sampler plunger (200) is being retrieved, scale is removed from the tubing string (110) via a hardened edge (214) on the lower sub (204) (Block 314). In Block 316, solids are collected for sampling, via the scale sampler plunger (200).

Embodiments disclosed above allow for scale removal and solid collection without the use of coiled tubing or slickline runs for downhole scale collection. One or more embodiments involve a scale sampler plunger (200) that can collect solids and remove scale. Embodiments disclosed above describe specific examples of a plunger lift system (100) make up using specific components in a specific order. However, any plunger lift system (100) with the scale sampler plunger (200) may be used without departing from the scope of the disclosure herein.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A scale sampler plunger having an upper end and a downhole end for a plunger lift system in a tubing string comprising:

a solid cylindrical member at the upper end of the scale sampler plunger configured to remove a plurality of contaminants in the tubing string;

a lower sub at the downhole end of the scale sampler plunger threaded to the solid cylindrical member, wherein the lower sub comprises a first section threaded to a second section extending axially from the first section;

wherein a fluid stream carrying solids flows from the tubing string into an entry opening located in the second section;

a deflector disposed in a chamber in the lower sub, wherein the deflector causes the fluid stream carrying solids to deposit the solids in the chamber in the lower sub; and an anchor disposed in the entry opening, wherein the anchor is fastened to the deflector and is configured to connect the entry opening to the deflector.

2. The scale sampler plunger in claim 1, further comprising:

an outlet in the first section configured to depart the fluid stream from the scale sampler plunger.

3. The scale sampler plunger in claim 1, further comprising:

an exit outlet in the second section configured to filter the fluid stream from the solids, wherein the fluid stream departs from the chamber to the tubing string through the exit outlet.

4. The scale sampler plunger in claim 1, wherein the chamber defines a receptacle.

5. The scale sampler plunger in claim 1, wherein the second section comprises a hardened edge configured to scrape off scale from the tubing string.

6. The scale sampler plunger in claim 1, wherein the solid cylindrical member is a plunger.

7. The scale sampler plunger in claim 6, wherein the plunger is a solid ring plunger.

8. The scale sampler plunger in claim 1, wherein the plurality of contaminants is scale.

9. The scale sampler plunger in claim 1, wherein the fluid stream carrying solids comprises a liquid component and solids.

10. The scale sampler plunger in claim 1, wherein the tubing string is a production tubing.

11. The scale sampler plunger in claim 1, wherein the anchor comprises at least two anchor legs creating an opening between the at least two anchor legs for the fluid stream to flow.

12. A method of removing solids from a tubing string in a well, the method comprising:

disposing a scale sampler plunger in the tubing string having a solid cylindrical member threaded to a lower sub, wherein the lower sub comprises a first section threaded to a second section, wherein a deflector is arranged within a chamber in the lower sub and is connected by an anchor to an entry opening of the second section;

removing a plurality of contaminants from the tubing string via the solid cylindrical member;

flowing a fluid stream carrying solids from the well into the lower sub via the entry opening to the second section, wherein solids are deposited into the chamber in the lower sub by the deflector;

departing the fluid stream from the first section, via an outlet, into the tubing string;

retrieving the scale sampler plunger from the well; and collecting the solids, via the scale sampler plunger, for sampling.

13. The method of claim 12, further comprising:

filtering the fluid stream from the solids in the second section, via an exit outlet, into the tubing string.

14. The method of claim 12, further comprising:

removing scale from the tubing string, via a hardened edge on the second section.

15. The method of claim 12, wherein the tubing string is a production tubing.

16. The method of claim 12, wherein the solid cylindrical member is a plunger.

17. The method of claim 16, wherein the plunger is a solid ring plunger.

18. The method of claim 12, wherein the plurality of contaminants is scale.

19. The method of claim 12, wherein the anchor comprises at least two anchor legs and creates an opening between the at least two anchor legs for the fluid stream to flow.

20. The method of claim 12, wherein the chamber defines a receptacle in the lower sub.

* * * * *